US011851976B2

(12) United States Patent
Cornelissen et al.

(10) Patent No.: US 11,851,976 B2
(45) Date of Patent: Dec. 26, 2023

(54) PUNCH AND INJECT TOOL FOR DOWNHOLE CASING AND METHOD FOR USE THEREOF

(71) Applicant: SHELL OIL COMPANY, Houston, TX (US)

(72) Inventors: Erik Kerst Cornelissen, Amsterdam (NL); Iris Cornelissen, Rijswijk (NL); Robbe Ibn Olieux, Rijswijk (NL); Sam Gerard Van Moorsel, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 95 days.

(21) Appl. No.: 17/603,666

(22) PCT Filed: May 12, 2020

(86) PCT No.: PCT/EP2020/063116
§ 371 (c)(1),
(2) Date: Oct. 14, 2021

(87) PCT Pub. No.: WO2020/229440
PCT Pub. Date: Nov. 19, 2020

(65) Prior Publication Data

US 2022/0298886 A1 Sep. 22, 2022

(30) Foreign Application Priority Data

May 15, 2019 (EP) ..... 19174667

(51) Int. Cl.
*E21B 33/13* (2006.01)
*E21B 43/112* (2006.01)
*E21B 34/10* (2006.01)

(52) U.S. Cl.
CPC ..... *E21B 33/13* (2013.01); *E21B 34/10* (2013.01); *E21B 43/112* (2013.01)

(58) Field of Classification Search
CPC ..... E21B 33/13; E21B 43/112; E21B 34/10
See application file for complete search history.

(56) References Cited

U.S. PATENT DOCUMENTS 2,381,929 A 8/1945 Schlumberger
3,161,235 A 12/1964 Carr
(Continued)

FOREIGN PATENT DOCUMENTS

CN 103410436 A 11/2013
WO 2016016477 A1 2/2016
(Continued)

OTHER PUBLICATIONS

Zwanenburg et al., "Well Abandonment: Abrasive Jetting to Access a Poorly Cemented Annulus and Placing a Sealant", Paper No. SPE-159216-MS, 2012.
(Continued)

*Primary Examiner* — Catherine Loikith
(74) *Attorney, Agent, or Firm* — SHELL USA, INC.

(57) ABSTRACT

A downhole tool, which includes a tool housing having a longitudinal axis, is equipped with a sting for punching a hole in a casing wall and injecting a sealant through the hole. The tube has a fluid channel to establish fluid communication from within the tool housing to an exterior of the tool housing through the fluid channel. A press device acts on the sting to force the sting in a radially outward direction from the tool housing. A check valve is arranged in the fluid channel, which allows fluid communication in a direction from within the tool housing to an exterior of the tool housing and which blocks fluid flow in an opposite direction. In use, the sting can perforate a casing wall and the sealant can be injected into an annular space around the casing.

12 Claims, 2 Drawing Sheets

(56) References Cited

U.S. PATENT DOCUMENTS

| | | | | |
|---|---|---|---|---|
| 4,640,362 | A | 2/1987 | Schellstede | |
| 4,651,828 | A | 3/1987 | Doremus | |
| 4,928,757 | A | 5/1990 | Schellstede et al. | |
| 5,107,943 | A * | 4/1992 | McQueen | E21B 43/114 175/286 |
| 5,183,111 | A | 2/1993 | Schellstede | |
| 6,155,150 | A * | 12/2000 | Cooper | E21B 43/112 83/13 |
| 7,409,990 | B1 | 8/2008 | Burts, Jr. et al. | |
| 2003/0213590 | A1 | 11/2003 | Bakke et al. | |
| 2008/0023205 | A1 | 1/2008 | Craster et al. | |
| 2009/0301720 | A1 | 12/2009 | Edwards et al. | |
| 2010/0078171 | A1 | 4/2010 | Moody et al. | |
| 2013/0233555 | A1 | 9/2013 | Hallundbaek et al. | |
| 2014/0102801 | A1 | 4/2014 | Hallundbæk et al. | |
| 2014/0374100 | A1 | 12/2014 | Hallundbaek | |
| 2015/0090454 | A1 | 4/2015 | Pasvandi | |

FOREIGN PATENT DOCUMENTS

| | | | |
|---|---|---|---|
| WO | 2017211361 | A1 | 12/2017 |
| WO | 2021170588 | A1 | 9/2021 |

OTHER PUBLICATIONS

Urdaneta et al., "Resin System Facilitates Shut-off of Difficult Gas Well", World Oil, Feb. 2015, pp. 101-104.

Anonymous: "CHDT Cased Hole Dynamics 1-12 Tester, Schlumberger", Jul. 1, 2014, XP055338518, 06 pages.

International Search Report and Written Opinion received for PCT Patent Application No. PCT/EP2017/083700, dated Apr. 18, 2018, 11 pages.

Office Action Received for Chinese Application No. 202080034825.9, dated Jan. 13, 2023, pp. 14 (7 Pages of English Translation and 7 Pages of Official Copy).

Office Action Received for Chinese Application No. 202080034825.9, dated Jul. 14, 2023, pp. 14 (7 Pages of English Translation and 7 Pages of Official Copy).

* cited by examiner

PUNCH AND INJECT TOOL FOR DOWNHOLE CASING AND METHOD FOR USE THEREOF

CROSS REFERENCE TO RELATED APPLICATIONS

This is a National stage application of International application No. PCT/EP2020/063116, filed 12 May 2020, which claims priority of European application No. 19174667.6, filed 15 May 2019, which is incorporated herein by reference in its entirety.

FIELD OF THE INVENTION

The present invention relates to a downhole tool for punching a hole in a casing wall and injecting a sealant from an interior space of the casing to an annulus around the casing. The invention further relates to a method of injecting a sealant in an annulus around a casing in a borehole.

BACKGROUND TO THE INVENTION

In the art of drilling and construction of boreholes in the earth, it is a common practice to install casing. The casing is generally cemented into place in the borehole by filling an annulus around the casing with cement. Over time, micro annuli or cracks may form in or adjacent to the body of cement in the annulus, which may cause unwanted leaks in the cement. Leaks may also be a result of bad displacement or shrinkage.

U.S. Pat. No. 2,381,929 describes a tool for sealing off the space between the wall of a borehole and its casing. The tool is adapted to perforate the casing, and also to inject sealing material (such as conventional cement or another hydrating material) into the space between the wall of the borehole and the casing through the perforation or perforations formed therein. The tool uses a punch which is forced through the casing.

After injecting the sealing material through the perforation, the punch is drawn back into the casing perforation. The punch is held in place by means of a screw made of relatively small section, which is designed to break under a tensile stress which is less than that required to withdraw the punch from the casing. Accordingly, when a force is applied to restore the perforating and injecting means to its normal position, the screw will break, leaving the punch jammed in the casing.

The tool of U.S. Pat. No. 2,381,929 suffers from a number of drawbacks. One is that the tool must be capable of exercising a tensile force on the punch. Moreover, the punch has to be drawn back into the casing before the sealing material has cured or hardened. The most important drawback, however, is that the seal created by the punch jammed in the casing is not guaranteed to succeed. If the seal is insufficient, the sealing material will flow back into the casing and thus risk leaving empty space in the annulus.

SUMMARY OF THE INVENTION

In one aspect, there is provided a downhole tool for punching a hole in a casing wall and injecting a sealant from an interior space of the casing to an annulus around the casing, comprising:

- a tool housing having a longitudinal axis;
- a sting comprising a fluid channel to establish fluid communication from within the tool housing to an exterior of the tool housing through the fluid channel;
- a press device acting on the sting to force the sting in a radially outward direction from the tool housing away from the longitudinal axis;
- a check valve arranged in said fluid channel which allows fluid communication in a direction from within the tool housing to an exterior of the tool housing and which blocks fluid flow in an opposite direction.

In another aspect, there is provided a method of injecting a sealant in an annulus around a casing in a borehole, said method comprising:

- traversing a punch and inject tool having a tool housing with a longitudinal axis axially through a casing which is prearranged in a borehole;
- forcing a sting in a radially outward direction from the tool housing, away from the longitudinal axis;
- injecting a sealant from within the tool housing to an exterior of the tool housing through a fluid channel defined by the sting and a check valve arranged in said fluid channel, whereby allowing fluid communication a direction from within the tool housing to an exterior of the tool housing and blocking fluid flow in an opposite direction.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION OF THE INVENTION

The person skilled in the art will readily understand that, while the detailed description of the invention will be illustrated making reference to one or more embodiments, each having specific combinations of features and measures, many of those features and measures can be equally or similarly applied independently in other embodiments or combinations.

Disclosed is a downhole tool for punching a hole in a casing wall and injecting a sealant from an interior space of the casing to an annulus around the casing. It makes use of a sting which can be forced through the casing wall from within the tool, to thereby perforate the casing wall. The sting can already be fit tightly in the casing wall, as the fluid channel is available for sealant injection. The sealant can then be injected trough a fluid channel provided within the sting, and into the annular space around the casing. A check valve keeps the sealant in the annular space, and the sting itself does not have to be repositioned to avoid any backflow of sealant.

The sting can thus fit tightly in the perforation, and leak paths between the sting and the casing wall can be minimized. An advantage of this tool is that it allows for curing or setting of the sealant without loss of casing integrity in case of a pressure differential. In fact, a better seal can be created as the tool allows for a compressive pre-stress on the sealant in the annulus.

The check valve may be configured in an internal cavity within the sting. This way the check valve mechanism is protected from the force the sting takes when perforating through the casing. The check valve itself is shielded from mechanical load during perforation, which guarantees its operation during injection.

In a preferred embodiment, a distal end of the sting, including the check vale, may be severed from the tool and left behind in the casing wall when the tool is retracted. This provides a significant time saving opportunity over systems which need to stay in place during the curing or setting process.

Figure 1:
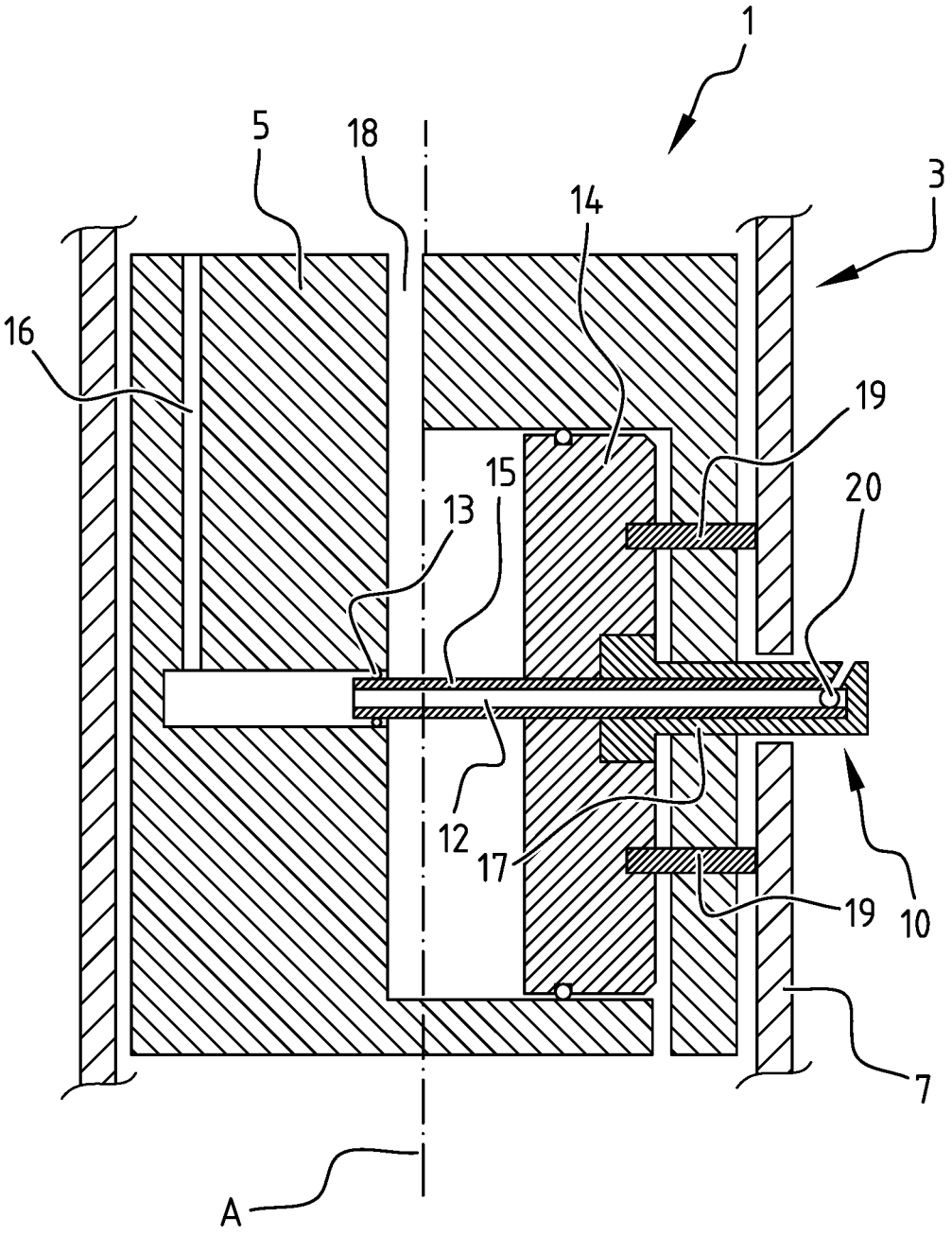
FIG. 1 shows a schematic cross-sectional view of a punch and inject tool within a casing with a sting perforating through the casing.

A simplified illustration of the tool is provided in FIG. 1, which shows the tool 1 deployed within the bore of a casing 3. The casing 3 may be cemented into a borehole or there may be an open annular space surrounding the casing. The annulus around the casing may be defined by an open hole (essentially formation rock) or another wellbore tubular.

The tool comprises a housing 5, which extends around a longitudinal axis A. Sting 10 comprises a fluid channel 12. Fluid communication can be established through the fluid channel 12, from within the tool housing 5 to an exterior of the tool housing. A press device 14 acts on the sting 10, to force the sting 10 in a radially outward direction from the tool housing 5, away from the longitudinal axis A, and preferably transversely to the longitudinal axis A. The sting 10 may perforate the surrounding casing wall 7.

Suitably, the sting 10 is assembled of an injection tube 15 of which the bore functions as the fluid channel 12, surrounded by a punch sheath 17. The materials of which the injection tube 15 and the punch sheath 17 are formed may be tailored to their respective functions. The injection tube merely contains the sealant, but in use is exposed ro only a relatively low mechanical load. Aluminium, or a composite polymer, may be suitable choices as a material for the injection tube 15. The punch sheath 17 on the other hand is forced through the casing wall 7, and should preferably be made of a much harder material such as tungsten carbide for example. As the sting 10 combines the functions of a perforating punch and an injection tube, it may be referred to as a punch and inject tube.

The press device 14 suitably comprises a piston which can be hydraulically powered. The piston may be integral to the sting 10 or engage with the sting 10 as for example illustrated in FIG. 1. The hydraulic fluid may be fed to the cylinder via a hydraulic line 18.

The force applied by the sting to the casing wall should be sufficient to essentially shear off a cylindrical piece from the casing wall. The shear force in theory equals the circumference around the perforation times the wall thickness times the shear strength of the material. When there is cement behind the casing the force should also be sufficient to displace or deform the cement.

While a hydraulic press device is suitable for this purpose, many other options exist including mechanical presses. The cylinder piston assembly is illustrated in a very basic form in FIG. 1, and the skilled person can apply normal design practices to optimize the assembly. For example, the piston may be oval in shape to enlarge its area in the longitudinal direction of the tool (as the transverse direction is usually limited by the casing size). The size will depend on the hydraulic pressure that is available for actuating the device.

A check valve 20 is arranged in the fluid channel 12. The check valve 12 is suitably configured in an internal cavity within the sting 10, fully shielded from external mechanical loading. The check valve 20 allows fluid communication in a direction from within the tool housing 5 to the exterior of the tool housing 5, but blocks fluid flow in opposite direction. The fluid channel 12 is connectable to a source of fluid sealant (not shown) via a sealant line 16. In the example of FIG. 1, the sting 10 is telescopically connected to the sealant line 16 by means of one or more sliding seals 13. Alternatives such as flexible lines may be used instead.

A stop body 19 may be provided, which moves with the sting 10 in the radially outward direction until the stop body 19 engages with an inside of the casing wall 7 when the downhole tool 1 is activated within the casing 3. Herewith a fixed predetermined maximum penetration depth of the sting 10 relative to the casing wall 7 is guaranteed, regardless of the location of the tool housing 5 within the casing 3.

Figure 2:
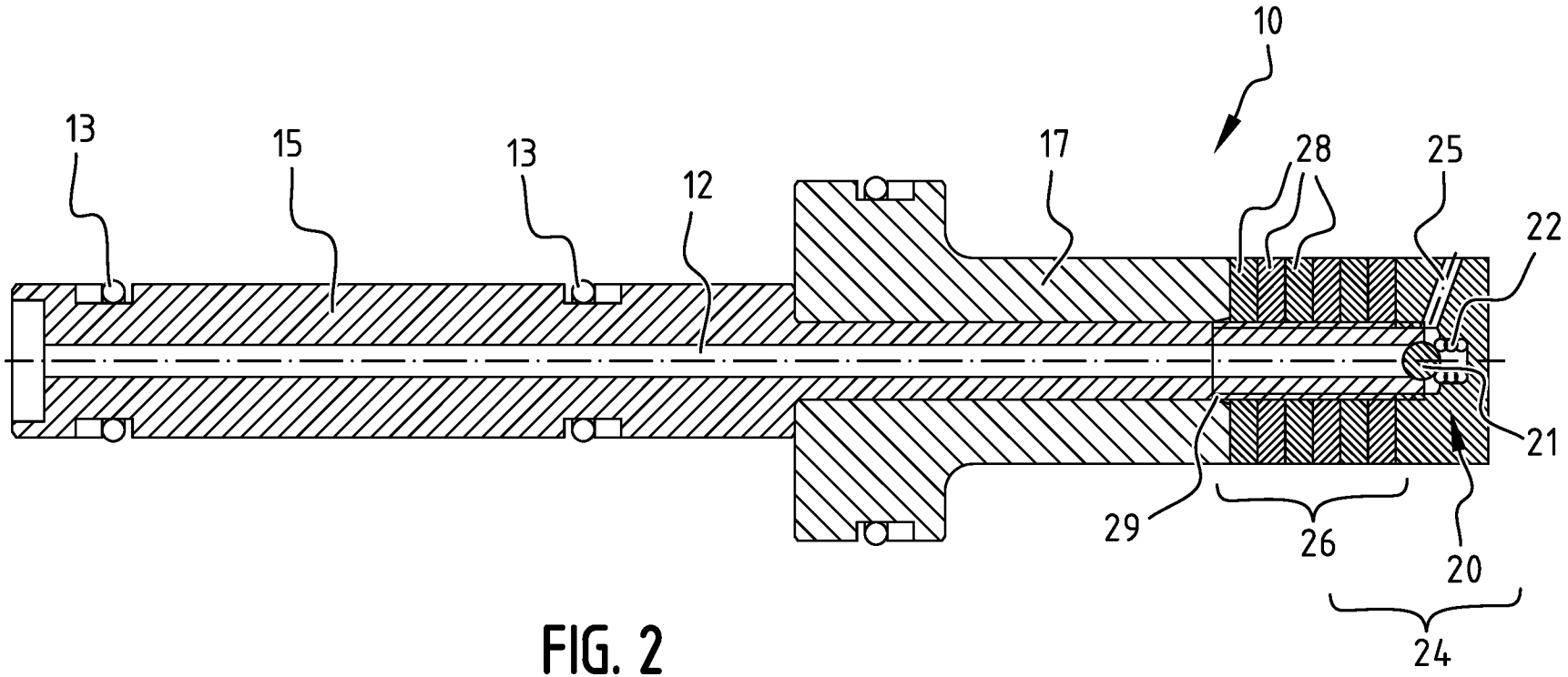
FIG. 2 shows a detailed cross-sectional view of the sting from FIG. 1.

FIG. 2 shows a detailed close up of the sting 10. Clearly visible is the injection tube 15 which is inserted into the punch sheath 17. The check valve 20 is provided in the form of a ball 21. Optionally a spring 22 is provided to keep the ball 21 in its seat when the pressure differential is zero or low. When the injection pressure of the sealant in fluid channel 12 exceeds the spring load and the external pressure in nozzle 25, then the check valve 20 opens whereby establishing a fluid communication between the fluid channel 12 and the nozzle 25.

The sting 10 suitably comprises a release section 26, to sever a distal end 24 of the sting 10 (on the right hand side of the drawing) from the tool housing. The check valve 20 is arranged in said distal end 24 of said sting 10. The release section 26 comprises a frangible zone which may be provided by for example pre-cuts into the punch sheath 17. As shown in FIG. 2, an elegant frangible zone is provided which comprises frangible tube section 29 reinforced by a plurality of reinforcement rings 28 around the frangible tube section 29 in mutual abutment with neighboring reinforcement rings. The frangible tube section 29 suitably has a thread which engages with the reinforcement rings 28.

The release section 26 is suitably outside of the tool housing 5 when the sting 10 has been forced out of the tool housing 5. Suitably, the release section 26 is then partly inside the casing wall 7 and partly inside the casing bore, so that it can break or shear off at the first exposed interface between to neighboring reinforcement rings 28 within the casing bore. The reinforcement rings 28 may be made of the same material as the remainder of the punch sheath 17.

In operation, the tool may be used as follows. The punch and inject tool 1 may be traversed through the bore of the casing 3, to a suitable location where an injection of sealant is desired. The sting 10 is then forced outward in a radially outward direction from the tool housing 5, away from the longitudinal axis A, and preferably transversely to the longitudinal axis A. The casing wall 7 is perforated with the sting 10.

Subsequently, the sealant is injected from within the tool housing 5 to an exterior of the tool housing and into an annular space around the casing 3. The sealant passes from a source (which may be integrated into the housing 5 or external to the housing 5), through the fluid channel 12 defined by the sting 10 and through the check valve 20 arranged in said fluid channel 12. During this phase of the operation, the distal end 24 of the sting 10 is tightly held in place by the casing wall 7. No fluids are required to pass through the perforation between the sting 10 and the casing wall 7.

The sealant may be a multi component composition (suitably an epoxy system) or any other liquid material which is capable of gaining sufficiently high viscosity or solidify after injection to create an adequate seal.

Alternatively, the sealant may be a single component resin system, which hardens by reaction with a wellbore fluid, such as water or brine. Such single component resin systems are described in, for example, EP application No. 20159582.4 filed 26 Feb. 2020, the disclosure of which is incorporated herein by reference. A suitable single component resin can be a moisture-curable polyurethane resin.

When a sufficient amount of sealant has been injected, the distal end 24 of the sting 10 may be severed. The check valve 20 is arranged in the distal end 24 of the sting 10 and thus it also remains behind stuck in the casing wall 7. The tool 1 may then be retracted through the bore of the casing 3, while leaving the distal end 24 behind. The sealant can then be left to cure or otherwise harden while the tool is already retrieved and prepared for a next round of operation.

The person skilled in the art will understand that the present invention can be carried out in many various ways without departing from the scope of the appended claims.

We claim:

1. A downhole tool for punching a hole in a casing wall and injecting a sealant through said hole, comprising:

a tool housing having a longitudinal axis;

a sting comprising a fluid channel to establish fluid communication from within the tool housing to an exterior of the tool housing through the fluid channel;

a press device acting on the sting to force the sting in a radially outward direction from the tool housing, transversely to the longitudinal axis; and a check valve arranged in said fluid channel which allows fluid communication in a direction from within the tool housing to the exterior of the tool housing and which blocks fluid flow in an opposite direction, wherein the sting comprises a release section to sever a distal end of the sting from the tool housing, whereby said check valve is arranged in said distal end of the sting.

2. The downhole tool of claim 1, wherein the check valve is in an internal cavity within the sting.

3. The downhole tool of claim 1, wherein said release section is outside of the tool housing when the sting has been forced in said radially outward direction from the tool housing.

4. The downhole tool of claim 1, wherein said release section comprises a frangible zone.

5. The downhole tool of claim 4, wherein said frangible zone comprises a frangible tube section reinforced by a plurality of reinforcement rings around the frangible tube section in mutual abutment with neighboring reinforcement rings.

6. The downhole tool of claim 1, further comprising a stop body on the sting which moves with the sting in said radially outward direction until the stop body engages with an inside of a casing wall when the downhole tool is activated within a casing.

7. The downhole tool of claim 1, wherein said fluid channel, inside of said tool housing, is connectable to a source of fluid sealant.

8. A method of injecting a sealant in an annulus around a casing in a borehole, said method comprising:

traversing a punch and inject tool having a tool housing with a longitudinal axis axially through a bore of a casing which is prearranged in a borehole;

forcing a sting in a radially outward direction from the tool housing, transversely to the longitudinal axis, whereby perforating a casing wall with said sting;

injecting a sealant from within the tool housing to an exterior of the tool housing and into an annular space around the casing, through a fluid channel defined by the sting and through a check valve arranged in said fluid channel, thereby allowing fluid communication a direction from within the tool housing to the exterior of the tool housing and blocking fluid flow in an opposite direction; and sever a distal end of the sting from the tool housing, whereby said check valve is arranged in said distal end of said sting.

9. The method of claim 8, wherein the check valve is shielded from external mechanical loading during perforating of the casing wall.

10. The method of claim 8, wherein said distal end remains stuck in the casing wall upon severing said distal end from the tool housing.

11. The method of claim 8, further comprising retracting the tool housing through the bore of the casing while leaving the distal end behind.

12. The method of claim 11, wherein the tool housing is retracted before the sealant in the annular space around the casing has hardened.

* * * * *